United States Patent [19]

Testerman

[11] Patent Number: 4,616,831

[45] Date of Patent: Oct. 14, 1986

[54] LOTTERY DEVICE

[76] Inventor: Ronald D. Testerman, 3810 Rock Run Rd., Havre DeGrace, Md.

[21] Appl. No.: 765,455

[22] Filed: Aug. 14, 1985

[51] Int. Cl.[4] ..... A63F 9/00
[52] U.S. Cl. ..... 273/144 B
[58] Field of Search ..... 273/144 A, 144 B

[56] References Cited

U.S. PATENT DOCUMENTS 2,203,886 6/1940 Zamora ..... 273/144 A

FOREIGN PATENT DOCUMENTS 2485936 1/1982 France ..... 273/144 A
WO84/00115 1/1984 Int'l Pat. Institute ..... 273/144 B

*Primary Examiner*—Paul E. Shapiro
*Attorney, Agent, or Firm*—Walter G. Finch

[57] ABSTRACT

The invention is a lottery device which can be used for numerous purposes such as, but not limited to, operation of a lottery, selecting random numbers, and for making other similar number selections. The device consists of a main base frame, a globe member, a ball selection member, a ball receiving tube, and a plurality of balls sequentially numbered.

12 Claims, 5 Drawing Figures

LOTTERY DEVICE

BACKGROUND AND SUMMARY OF THE INVENTION

The invention relates to numbers selection apparatuses, and in particular to devices that randomly select numbers. Specifically, it relates to a lottery device.

The lottery devices of the present invention may be used for the operation of an official lottery, for preselection of a number to play in a lottery or numbers game, to select a series of numbers in a random manner, or for other similar needs to select numbers.

The lottery device of this invention may be arranged with a specifically numbered plurality of balls so that one machine of the present invention be used instead of a plurality of machines as used at present in the prior art for the operation of lotteries.

For example, the present invention may be used for the random selection of a single digit number from 0 through 9; or it may be used to select multiple random number selections of more than a single digit, but with one series of numbered units 0 through 9 to generate the random number selections.

The device may also be used for the random selection of multiple numbers by using a plurality of series of numbered units 0 through 9, one such series for each number in the multiple number to be selected. This latter arrangement making it possible to obtain a multiple number of two or more digits with the same number repeated, such as 55 or 777.

The lottery device may be arranged to be operated manually or it may be powered. The lottery device of this invention may be used as a toy.

The device operates with the plurality of sequentially numbered balls 0 through 9, or a series of sequentially numbered balls 0 through 9, encased in a globe-like member and free to roll about therewithin. A ball receiving tube member serves as an axle through the center of the globe-like enclosed member, the axle means being set at an angle to the horizontal plane with the globe-like member affixed thereon. The ends of the axle means being set on a main base frame having two support members that maintain the axle means set at the aforementioned angle to the horizontal plane.

The ball receiving tube member has an aperture in the side of the tube-like member to permit one of the plurality of sequentially numbered balls to pass therethrough from the interior of the globe-like member into the interior of the ball receiving tube member and retain it there for reading and recording the number of the ball so captured in the tube.

With the ball receiving tube member, serving as the axle means, set at the angle with the horizontal, the captured numbered ball will roll to the lowermost end thereof. The ends of the ball receiving tube member are closed so as to retain the captured ball or balls. By tilting the device the balls can be dumped back into the glove-like enclosure through the aperture in the ball receiving tube member.

On the interior of the globe-like member is a half cupped-like member on which the ball can be scooped up as the globe turns on the axle means and the cupped-like member passes through the mass of the plurality of sequentially numbered balls in the globe-like member.

When turned at the proper speed, which can be predetermined, the revolving globe-like member and the axle means to which it is affixed will be at a predetermined position as the one scooped up balls rolls out of the half cupped-like member and drops into the aperture in the ball receiving tube member.

The turning of the globe-like member and the axle means to which it is affixed, the ball receiving tube member with the aperture therein, may be revolved manually or mechanically. However, the speed of revolving must be such that a scooped-up ball on the half cupped-like ball selection member will roll out of the half cupped-like member and drop through the aperture in the ball receiving tube member.

It is to be noted and understood that it is to within the scope and intent of this invention to provide a double side half cupped-like ball selection member for use when the globe-like member is revolved in either direction.

It is to be noted and understood that instead of the globe-like member being affixed to the ball receiving tube member and combined structure being rotated together that it is within the scope and intent of this invention that the position of the ball receiving tube member may be set in a fixed position with aperture in an upper or topmost position, and the globe-like member revolved around the ball receiving tube member as a separate axle means. In this arrangement a ball will also be scooped up and, at the proper speed, dropped through the aperture in the ball receiving tube member.

The numbered balls may be sequentially numbered through a long range of numbers, such as 1 through 100, or other series, for the random selection of numbers over a wide range.

Thus, the operation of the present lottery device may be operated to select one ball or a plurality of balls into the ball receiving tube member. The device may also be operated as aforementioned through a single set or series of sequentially numbered balls 0 through 9, or through a plurality of sets or series of such sequentially numbered balls 0 through 9.

It is, therefore, an object of this invention to provide a device for operation of a lottery.

It is also an object of this invention to provide a device which can be used for the selection of random numbers.

It is another object of this invention to provide a device which may be operated manually or mechanically.

It is still another object of this invention to provide a device that may be used to select a single digit number or a multiple number of several digits.

It is yet another object of this invention to provide a device that can have selected numbered units returned to the basic container of all other numbered units in a very simple manner.

Further objects and advantages of the invention will become more apparent in light of the following description of the preferred embodiments.

DESCRIPTION OF THE PREFERRED EMBODIMENTS

Figure 1:
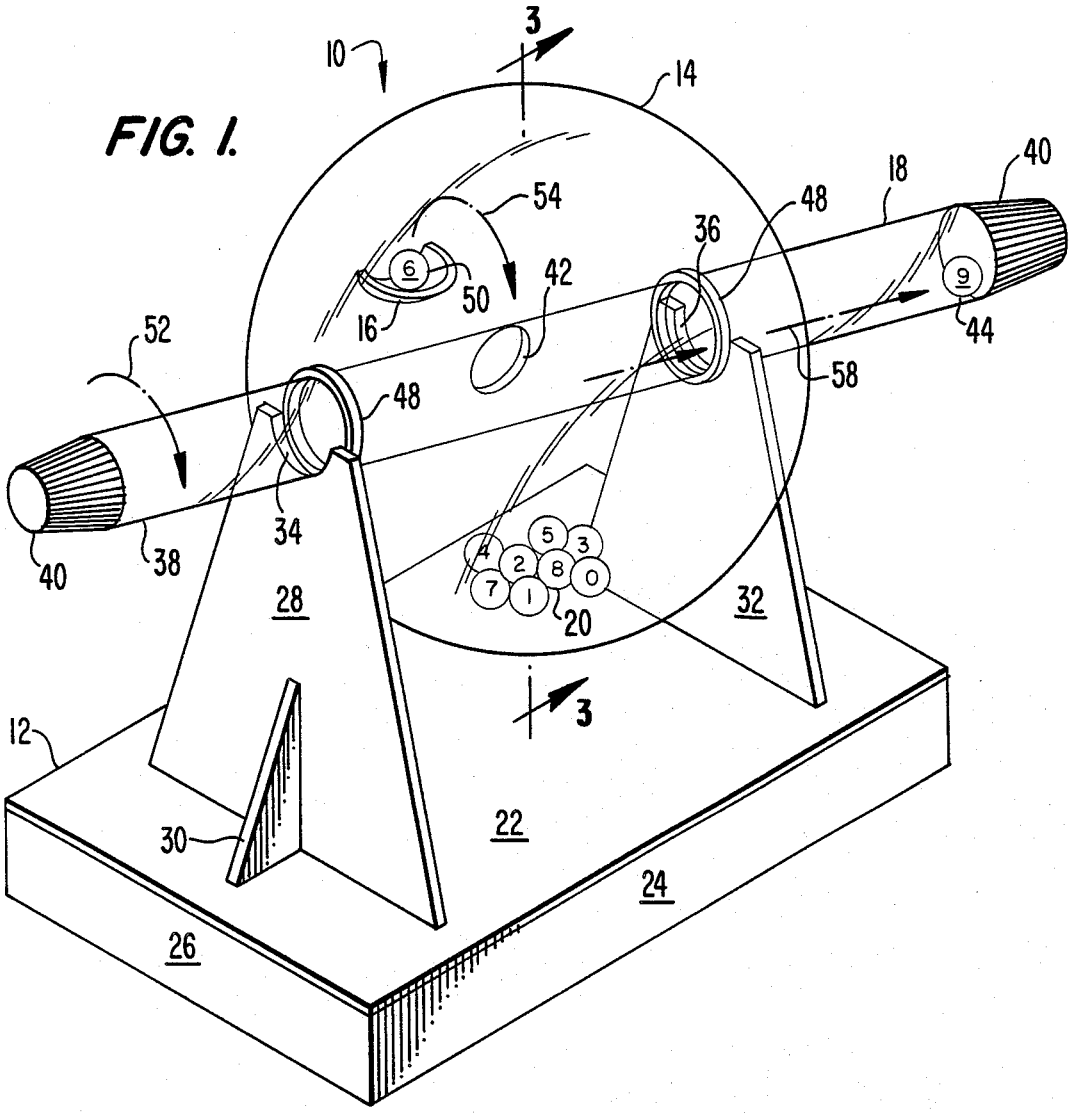
FIG. 1 is a pictorial view of a lottery device.

Referring now to the drawings, and particularly to FIG. 1, a lottery device is shown at 10 in a pictorial view.

The lottery device 10 is composed of a main base frame structure 12, a globe structure 14, a ball selection member 16, a ball receiving tube member 18, and a plurality of sequentially marked balls 20. The elements of these components will be described hereinafter, along with their cooperation with each other.

The main base frame structure 12 consists of a base top member 22, side members 24, end members 26, a first support member 28, having a reinforcement member 30, and a second support member 32, having a reinforcement member 30.

It is to be noted and understood that the main base frame structure 12 may also be constructed with a solid one-piece base top member 22 without the side members 24 and end members 26 within the scope and intent of the invention.

It is also to be noted and understood that there is a side member 24 and an end member 26 opposite to those shown in FIG. 1, under the base top member 22. The above mentioned side member 24 and end member 26 cannot be seen in FIG. 1.

It is further to be noted and understood that the reinforcement member 30 for the second support member 32 exists, but cannot be seen in FIG. 1.

At the topmost end of the first support member 28 is a first bearing-like recess means 34 to support the uppermost end of the ball receiving tube member 18. At the topmost end of the second support member 32 is a second bearing-like recess means 36 to support the lowermost end of the ball receiving tube member 18. Note that the angle with the horizontal, at which the ball receiving tube member 18 is set, provides for the uppermost end of the ball receiving tube member 18 resting in the first bearing-like recess means 34, and also provides for the lowermost end of the ball receiving tube member 18 resting in the second bearing-like recess means 36.

As shown in FIG. 1 the lottery device 10, which can also be used for the selection of random numbers and other similar numbers selections, is shown for ordinary manual operation. As noted hereinbefore, the lottery device 10 may also be operated mechanically. For mechanical operation the first and second bearing-like recess means 34 and 36, respectively, are replaced with mechanical type bearings through which the ball receiving tube member 18 passes and within which the ball receiving tube member 18 bears and is held in place. In the latter case a mechanical means, such as an electric motor, is geared to or connected by a pulley and sheave arrangement to turn or revolve the combined globe structure 14 and ball receiving tube member 18 at the proper speed, as mentioned hereinbefore and as discussed in detail hereinafter.

Figure 3:
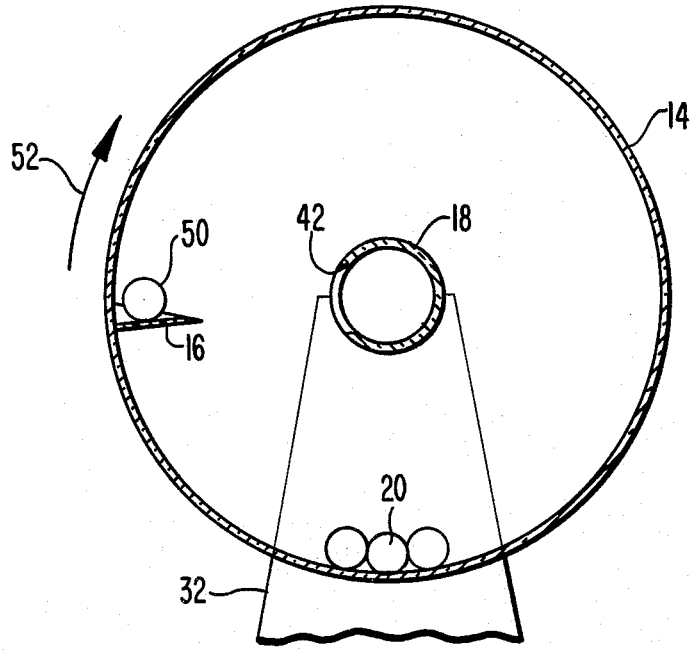
FIG. 3 is a partial cross-sectional view of FIG. 1 on line 3—3, showing a ball selection member is a preliminary position.
Figure 4:
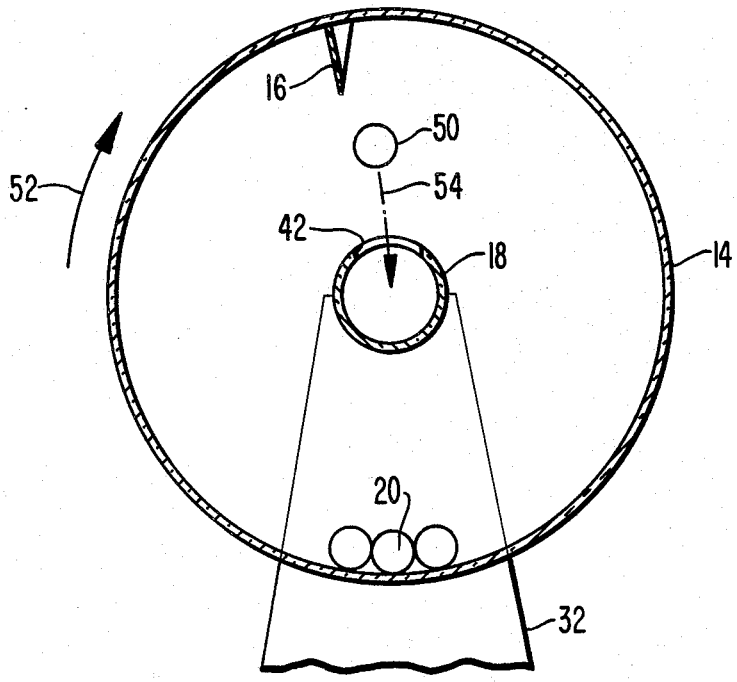
FIG. 4 is a partial cross-section view similar to FIG. 3, but showing the ball selection member in a position of dropping a selected ball into an aperture in the ball receiving member of FIG. 2.

The globe structure 14 as shwon in FIGS. 1, 3, and 4 are depicted as being of a clear material, such as a clear plastics in order to observe the action of the plurality of balls 20 during operation, and also to be able to see better the structure of the second support member 32. It is to be noted and understood, however, that the globe structure may be made in a colored material or of other than a plastics.

The main base frame structure 12 and its elements may be made of a plastics, metal, or other suitable material. The elements of the main base frame structure 12 are suitably affixed to each other in positions as shown in FIG. 1.

Figure 2:
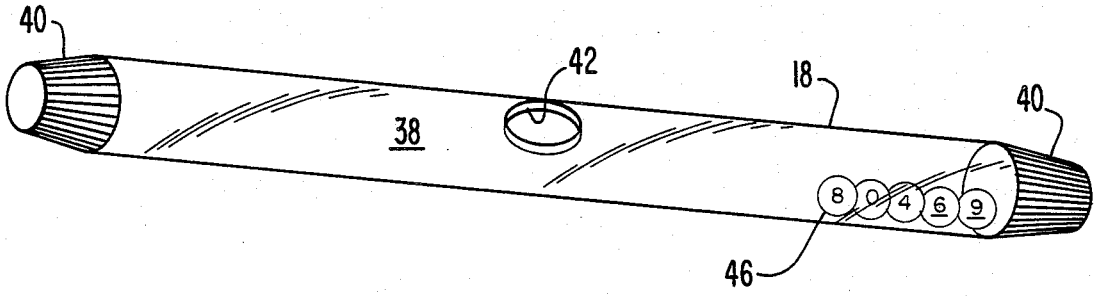
FIG. 2 is a pictorial view of a ball receiving member of the lottery device of FIG. 1, showing a portion of numbered balls therein.

Turning now to FIG. 2, the elements of the ball receiving tube member 18 are defined. The ball receiving tube member 18 consists of a main body means 38, and a pair of solid end closure means 40. The main tube body means 38 has a circular aperture 42 in the side thereof, spaced equidistant from the ends of the main tube body means 38. The pair of solid end closure means 40 being serrated or knurled on the outside thereof and used to close the open ends of the main tube body means 38, the solid end closure means 40 being suitably affixed to the open ends of the main tube body means 38. It is to be noted that one of the pair of solid end closure means 40 may be removably affixed to the main tube body means 38 so that the plurality of sequentially marked balls may be removed and replaced with a different set or to have additional balls added.

In FIG. 2 note that a group 46 of the plurality of numbered balls 20 is shown within the ball receiving tube member 18. Thus, in selecting numbers for a lottery, or for any other purpose, a quantity of balls may be captured, as described hereinafter, such as the five ball group 46.

It is to be noted and understood that there may be any number of balls in the group 46, limited only by the length of the ball receiving tube member 18 between the aperture 42 and the lowermost end of the ball receiving tube member 18 when mounted as in FIG. 1. Likewise, the captured number of the plurality of sequentially marked balls 20 may be limited to one ball 44, as shown in the ball receiving tube member 18 in FIG. 1, if only a single number is desired or required.

The ball receiving tube member 18 is preferably of a clear material, such as clear plastics, so both the numbers or markings on captured balls can be read easily.

When the ball receiving tube member 18 is mounted in and through the globe structure 14 a pair of space maintenance members 48 are suitably affixed to the ball receiving tube member 18 and to the globe structure 14. The pair of space maintenance members 48 maintain the position of the combined assembled globe structure 14 and the ball receiving tube member 18 within and upon the first and second support member 28 and 32, respectively. Line-up points may be marked on the globe structrue 14 and the ball receiving tube member to line them up for assembly.

Inside of the globe structure 14 is a ball selection member 16, suitably affixed to the inside of the spherical globe structure 14. The ball selecting member 16 is half cupped-like in configuration, as seen in FIG. 1. The half cupped-like ball selection member 16 is located in a position so that one ball 50 is captured in the ball selecting member 16 as the ball selection member 16 scoops through the plurality of marked balls 20 as the globe structure 14 is revolved or turned in the direction of the arrow 52. The ball selection member 16 also serves as a mixer of the plurality of sequentially marked balls 20 each time it passes through the mass.

As the globe structure 14 revolves or turns, as noted hereinbefore, the captured ball 50 at the proper speed of turning will roll out of the half cupped-like ball selection member 16, in the direction of the arrow 54 and drop through the aperture 42 into the interior of the main tube body means 38 of the ball receiving tube member 18. Tilting the ball receiving member 18 in the opposite direction will return the construed ball or balls through the aperture 42 and into the globe structure 14.

FIG. 3 shows a cross-section through the globe structure 14 with the captured ball 50 in the ball selection member 16 as the globe structure 14 turns in the direction of the arrow 52. FIG. 4 shows the globe structure 14 as having reached a position where the captured ball 50 has rolled out of the ball selection member 16 and is headed in the trajectory direction 54 to drop through the aperture 42 and into the ball receiving member 18. This action can be repeated to capture and deposit one ball or a group of balls from the plurality of sequentially marked balls 20. As any catured ball 50 enters the ball receiving tube member 18, the ball rolls in the direction of the arrow 58 to the lowermost end of the ball receiving tube member 18.

Figure 5:
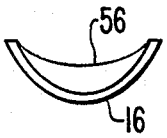
FIG. 5 is an end view of a ball selection member of the lottery device of FIG. 1.

An end view of the ball selection member 16 is shown in FIG. 5, and in cross-section in FIGS. 3 and 4. As shown in FIG. 5, the ball selection member 16 rearward edge or surface 56 is the portion which is suitably affixed to the inside surface of the globe structure 14.

As noted hereinbefore, the plurality of sequentially marked balls 20 may be marked 0 through 9 or in any other manner desired or required for the selections to be made, including letters or special markings. .

The spherical configuration of the globe structure 14 permits the plurality of sequentially marked balls 20 to roll around the inside periphery of the globe structure 14. At the same time the spherical configuration also concentrates the plurality of sequentially marked balls 20 centered at the bottommost portion of the globe structure 14, so that the scooping action of the ball selection member 16 will always pass through the total mass or any remaining portion of the total mass as one or more of the plurality of balls 20 are removed. In the operation of this device it can be seen that this one device can replace a plurality or prior art lottery machines when selecting multiple lottery numbers.

As can be readily understood from the foregoing description of the invention, the present structure can be configured in different modes to provide the ability to select numbers in a lottery manner or as in a random selection.

Accordingly, modifications and variations to which the invention is susceptible may be practiced without departing from the scope and intent of the appended claims.

What is claimed is:

1. A device for selecting random numbers and other similar combinations, comprising:

a main base frame structure, said main frame having first and second surfaces, one of said surfaces being set at a higher elevation than the other of said first and second surfaces;

a globe like structure;

a tube-like member having an aperture provided in its side wall, said tube-like member being suitably located through and extending from each side of said globe-like structure and affixed thereto, said tube-like member being suitably removably affixed to said main base frame structure;

a pair of closure means, said pair of closure means being suitably affixed to said tube-like member, at least one of said pair of closure means being removably so affixed;

a ball selection means, said ball selection means being suitably affixed to the inside of said globe-like structure; and a plurality of sequentially marked balls, said plurality of sequentially marked balls being located within said globe-like structure.

2. A device for selecting random numbers and other similar combinations as recited in claim 1, wherein said main base frame structure has a first bearing surface and a second bearing surface, said first bearing surface being set at a higher elevation than said second bearing surface.

3. A device for selecting random numbers and other similar combinations as recited in claim 2, wherein said globe-like structure is spherical in configuration and hollow and being an interior spherical wall, said globe-like structrue having two apertures therein, said two apertures in said globe-like structure being opposite to each other.

4. A device for selecting random numbers and other similar combinations as recited in claim 3, wherein said tube-like member is circular in configuration, hollow with a passageway therethrough, said tube-like member having a first end and a second end, said aperture being located approximately equally spaced from said first and second ends of said tube-like member, said tube-like member being passed through said two apertures in said globe-like structure and located so that said first and second ends extend equally from each side of said globe-like structure and so that said tube-like member is located approximately centrally between said interior spherical walls of said globe-like structure at said apertures therein, said tube-like structure, having said first and second ends that extend equally from each side of said globe-like structure, located in and upon said first and second bearing surfaces, respectively, said tube-like member thereby being set at an angle with the horizontal.

5. A device for selecting random numbers and other similar combinations as recited in claim 4, wherein said pair of closure means are suitably affixed to said first and second ends of said tube-like members.

6. A device for selecting random numbers and other similar combinations as recited in claim 5, wherein said ball selection means is half cupped-like in configuration.

7. A device for selecting random numbers and other similar combinations as recited in claim 5 and additionally, first and second space maintenance members, said first maintenance member being located on said tube-like member at said globe-like structure and suitably affixed to said tube-like member between said globe-like structure and said first bearing surface, said second space maintenance member being located on said tube-like member at said globe-like structure and suitably affixed to said tube-like member between said globe-like structure and said second bearing surface.

8. A device for selecting random numbers and other similar combinations as recited in claim 5, wherein said pair of closure means are each serrated on the exterior surface thereof.

9. A device for selecting random numbers and other similar combinations as recited in claim 8, wherein said tube-like member with affixed globe-like structure is rotated and revolved within said first and second bearing surface so that said ball selection means passes through and mixes said plurality of sequentially marked balls, said ball selection means during rotation randomly selecting and picking up one of said plurality of sequentially marked balls and, at proper speed, having said picked up ball roll out of said ball selection means and pass through said aperture in said tube-like member and into said passageway in said tube-like member where it is retained at the lowermost point thereof, said ball selection member being located within said globe-like structure so that the trajectory of said picked up ball rolling out of said ball selection means will be directed to said aperture in said tube-like member, continued revolution of said tube-like member with affixed globe-like structure being capable of picking up and depositing additional balls into said tube-like member.

10. A device for selecting random numbers and other similar combinations as recited in claim 1 and additionally first and second space maintenance members, said first maintenance member being located on said tube-like member at said globe-like structure and suitably affixed to said tube-like member between said globe-like structure and said first bearing surface, said second space maintenance member being located on said tube-like member at said globe-like structure and suitably affixed to said tube-like member between said globe-like structure and said second bearing surfaces.

11. A device for selecting random numbers and other similar combinations as recited in claim 1, wherein said pair of closure means are each serrated on the exterior surface thereof.

12. A device for selecting random numbers and other similar combinations as recited in claim 11, wherein said tube-like member with the affixed globe-like structure is rotated and revolved within said first and second bearing surfaces so that said ball selection means passes through and mixes said plurality of sequentially marked balls, said ball selection means during rotation randomly selecting and picking up one of said plurality of sequentially marked balls and, at proper speed, having said picked up ball roll out of said ball selection means and pass through said aperture in said tube-like member and into said passageway in said tube-like member where it is retained at the lowermost point thereof, said ball selection means being located within said globe-like structure so that the trajectory of said picked up ball rolling out of said ball selection means will be directed to said aperture in said tube-like member, continued revolution of said tube-like member with affixed globe-like structure being capable of picking up and depositing additional balls into said tube-like member.

* * * * *